US006233846B1

(12) United States Patent
Sordi

(10) Patent No.: US 6,233,846 B1
(45) Date of Patent: May 22, 2001

(54) SHOE, ESPECIALLY SPORTS OR DANCING SHOE

(75) Inventor: Luca Sordi, Chiavari (IT)

(73) Assignee: Freddy S.p.A., Chiavari (IT)

( * ) Notice: Subject to any disclaimer, the term of this patent is extended or adjusted under 35 U.S.C. 154(b) by 0 days.

(21) Appl. No.: 09/410,293

(22) Filed: Sep. 30, 1999

Related U.S. Application Data

(63) Continuation-in-part of application No. PCT/EP99/00621, filed on Feb. 1, 1999.

(30) Foreign Application Priority Data

Jan. 31, 1998 (DE) ..... 298 01 638.9

(51) Int. Cl.[7] ..... A43B 13/18

(52) U.S. Cl. ..... 36/28; 36/105; 36/80; 36/8.3; 36/42

(58) Field of Search ..... 36/8.3, 113, 148, 36/149, 151, 152, 96, 25 R, 27, 21, 76 R, 108

(56) References Cited

U.S. PATENT DOCUMENTS

| | | | | |
|---|---|---|---|---|
| 2,361,511 | | 10/1944 | Stritter . | |
| 2,780,013 | * | 2/1957 | Voss | 36/105 |
| 2,814,133 | * | 11/1957 | Herbst | 36/80 |
| 3,290,801 | | 12/1966 | Bente . | |
| 5,402,588 | * | 4/1995 | Graham et al. | 36/28 |
| 5,611,152 | * | 3/1997 | Richard et al. | 36/28 |
| 5,649,374 | * | 7/1997 | Chou | 36/28 |
| 5,682,685 | * | 11/1997 | Terlizzi | 36/8.3 |
| 5,937,544 | * | 8/1999 | Russel | 36/28 |
| 5,970,628 | * | 10/1999 | Meschan | 36/42 |

FOREIGN PATENT DOCUMENTS

| | | |
|---|---|---|
| 298 01 638 U | 11/1998 | (DE) . |
| 0 777 982 A1 | 12/1996 | (EP) . |
| 2243530 | 11/1991 | (GB) . |

* cited by examiner

*Primary Examiner*—Paul T. Sewell
*Assistant Examiner*—Troy Arnold
(74) *Attorney, Agent, or Firm*—Graybeal Jackson Haley LLP

(57) ABSTRACT

The shoe has a sole which has a ball section and a heel, the heel having an open middle section under the heel of the foot which is bridged by a bridging element. The bridging element is rigid. The open middle section of the heel can reach as far as the front edge of the heel so that this is U- or C-shaped. The edge section of the bridging element can overlap with the inner edge of the heel. The ball section of the sole can be separated from the heel so that both are connected to the upper part of the shoe without being directly connected to each other, or the bridging element can reach as far as the ball section and overlaps with approximately one third of this.

13 Claims, 6 Drawing Sheets

SHOE, ESPECIALLY SPORTS OR DANCING SHOE

Figure 1:
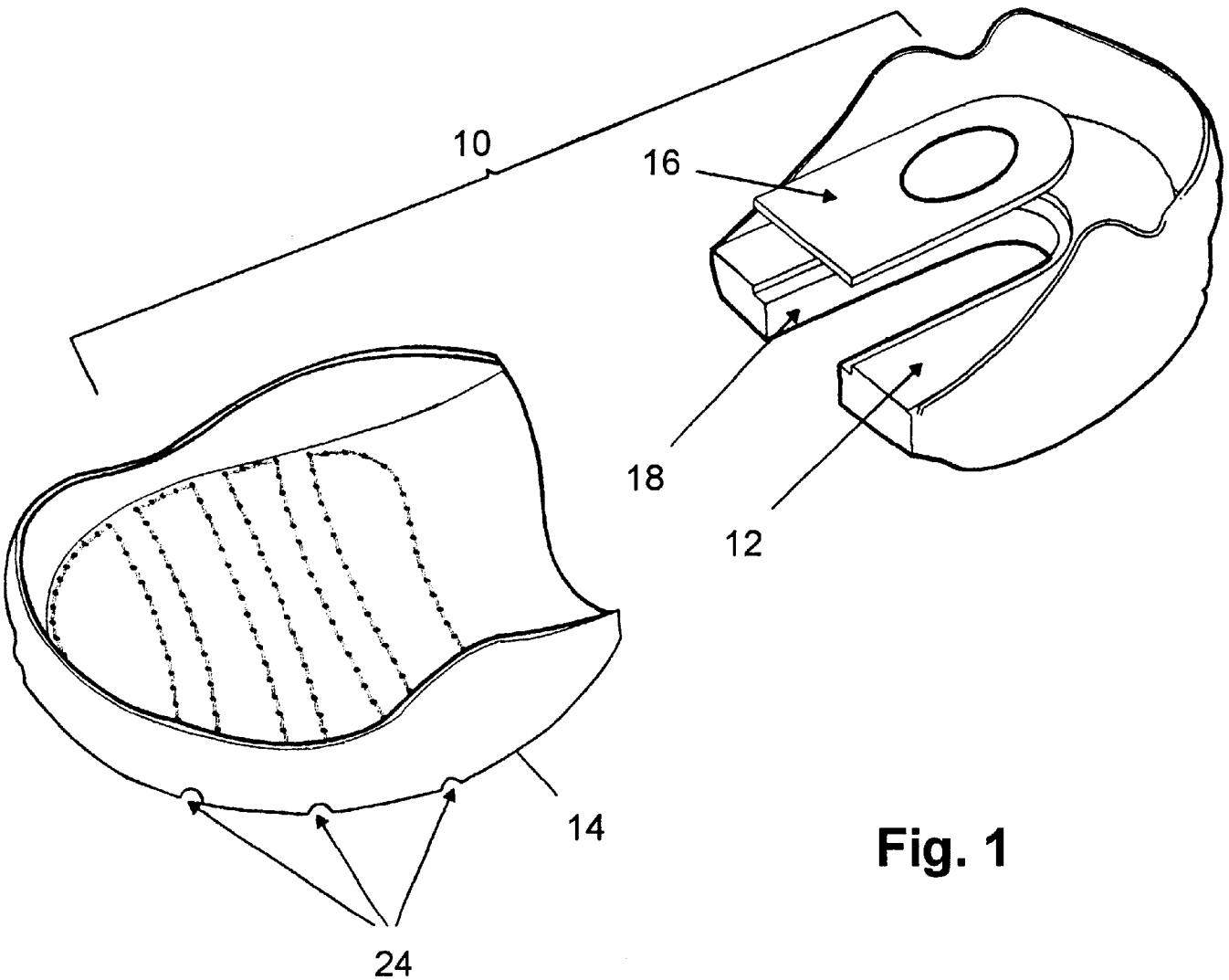

This application is a Continuation-in-Part of PCT/EP99/00621 filed Feb. 1, 1999.

DESCRIPTION

The invention relates to a shoe, in particular a sports or dancing shoe, the sole of which has a ball section and a heel, the heel having an open middle section under the heel of the foot which is bridged by a bridging element.

Such a shoe is known, the bridging element being composed of a pliable material, e.g. a plastic woven fabric. In particular for sports and dancing, it would be desirable to have a shoe with a greater damping capacity and better lateral stability.

The object of the invention is therefore to create a shoe with a higher damping capacity and a greater lateral stability.

This object is achieved according to the invention in that the bridging element is rigid.

Through the rigidity of the bridging element, the body weight is concentrated on the inner edge section of the heel and forces are scarcely introduced into the heel in a horizontal direction by the bridging element.

The width or transverse diameter of the open middle section is approximately 2 to 3 cm. Preferably, the open middle section of the heel reaches as far as the front edge of the heel so that the latter as a whole has a U- or C-shape open to the front with an outer edge, an inner edge and a front edge.

Preferably, the bridging element does not cover the whole heel, but an edge section of the heel remains free on the sides and at the rear end, i.e. along the outer edge. The overlap section between the inner edge and the rigid bridging element can be approximately 1 cm.

In the dancing shoe version, the heel of the shoe according to the invention preferably has a C or U shape open to the front and the bridging element reaches as far as the front edge of the heel and thus covers the entire open inner surface of the U- or C-shape including an overlap section approximately 1 cm in width. The ball section of the sole is not directly connected to the heel, but the two parts of the sole are each connected to the upper part of the shoe. The ball section of the sole has the customary somewhat oval shape with transverse grooves so that the front part of the shoe rolls off round several transverse axes. The heel and the ball section are preferably compression moulded from polyurethane. Suede strips are let into the underside of the ball section and sewn on.

In the sports shoe version, the heel of the shoe according to the invention likewise preferably has a U- or C-shape open to the front, but the bridging element is extended beyond the front edge of the heel as far as ball section of the sole, widens there considerably and covers approximately the rear third of the ball section. The ball section of the sole can likewise have a U- or C-shape and open to the back. The overlap section between the bridging element and the ball section of the shoe is preferably considerably larger. In this version, the bridging element simultaneously functions as the waist of the sole. The heel and the ball section are of the sole consist expediently of high-density EVA (ethylene-vinyl acetate) and are preferably compression moulded.

The bridging element preferably consists in both versions of a very rigid and hard plastic and in each case can be made downwardly thicker in the middle, i.e. under the heel of the foot and optionally in the middle of the ball section. On the upper side, the bridging element is smooth and level. The bridging element can consist of fibre-reinforced plastic and likewise be compression moulded.

The edge of the heel and also of the ball section of the sole also are turned up at the outer edge and are also connected to the upper part of the shoe in this section. The upper part of the shoe is in general composed of plastic woven fabric and/or synthetic or real leather and extended up to or over the ankle.

Figure 2:
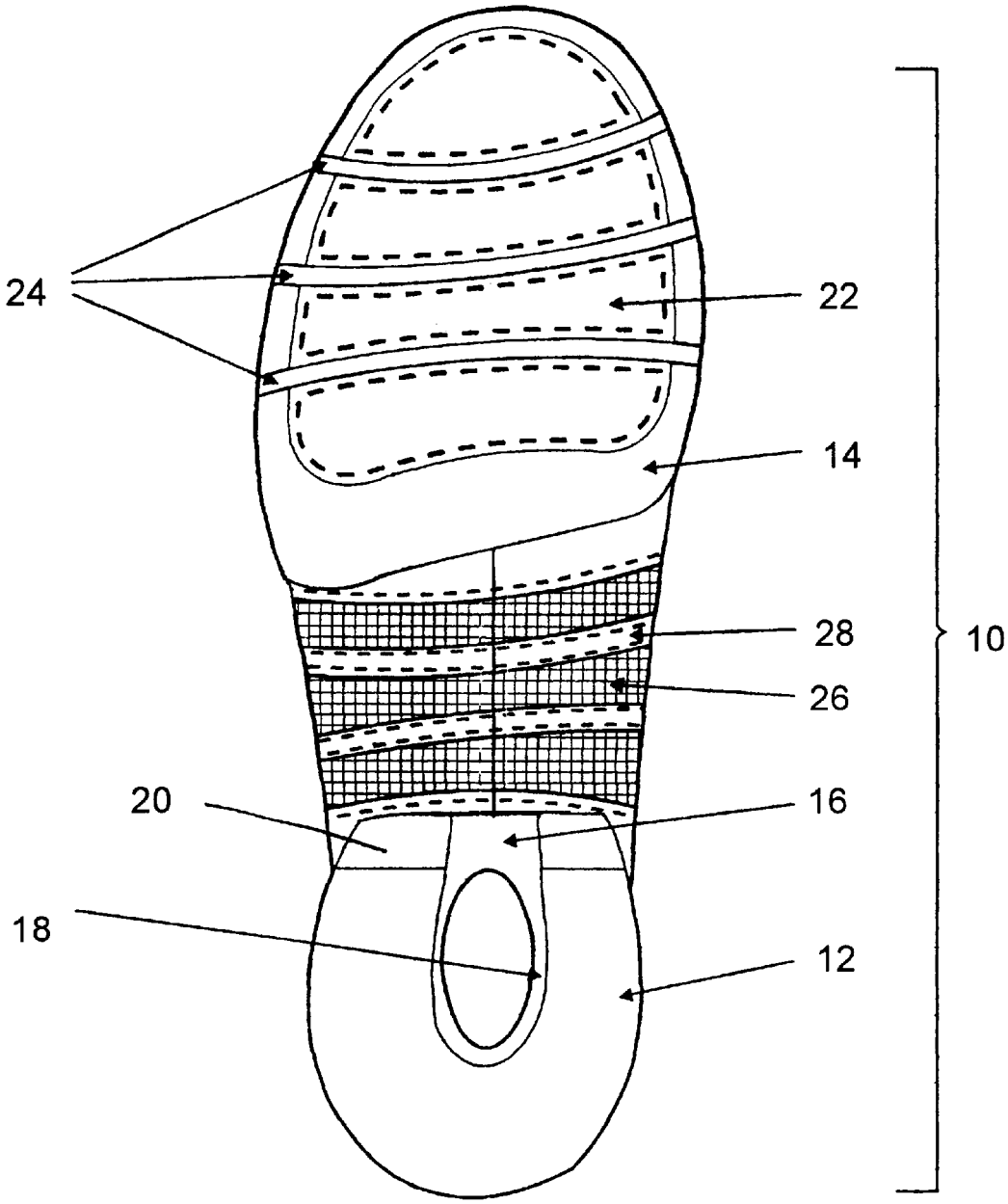
Figure 3:
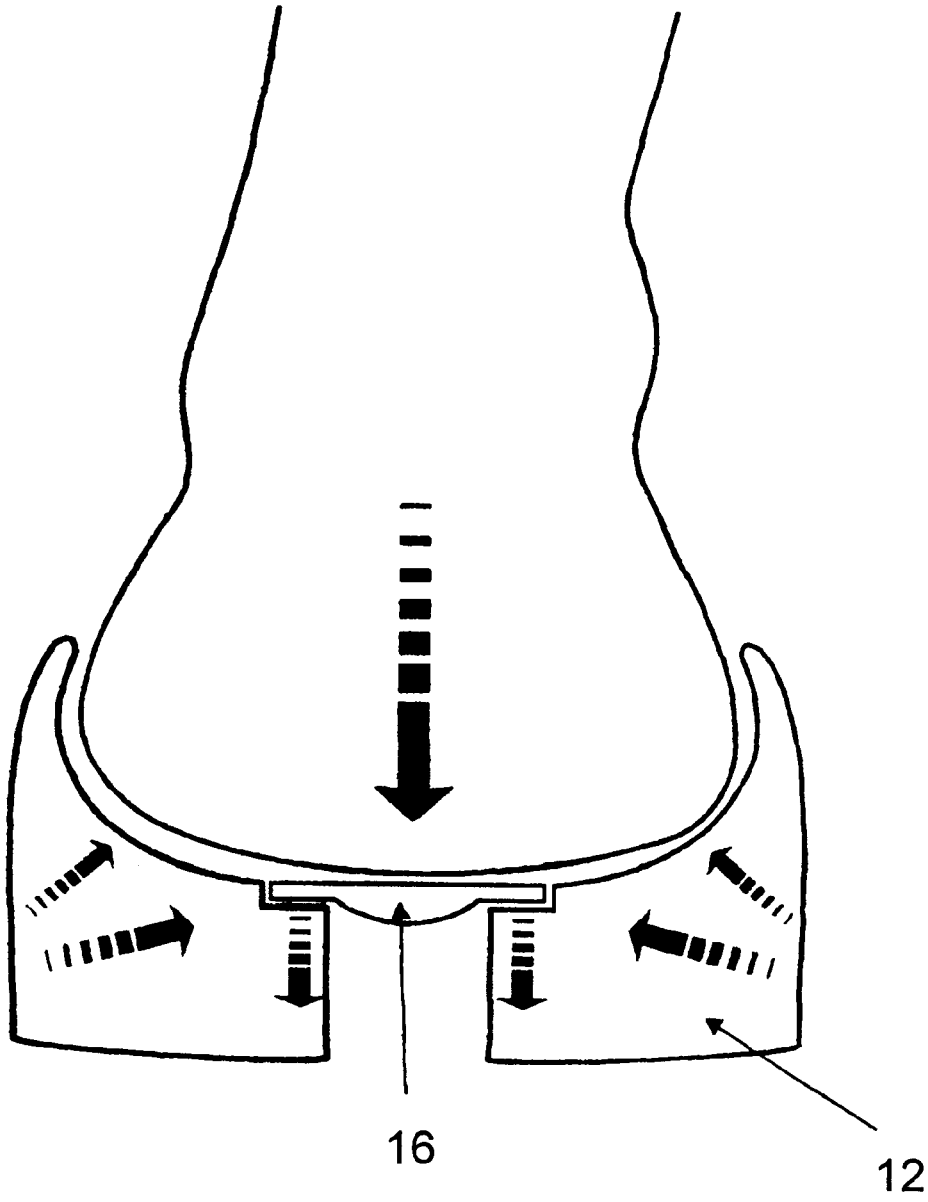
Figure 4:
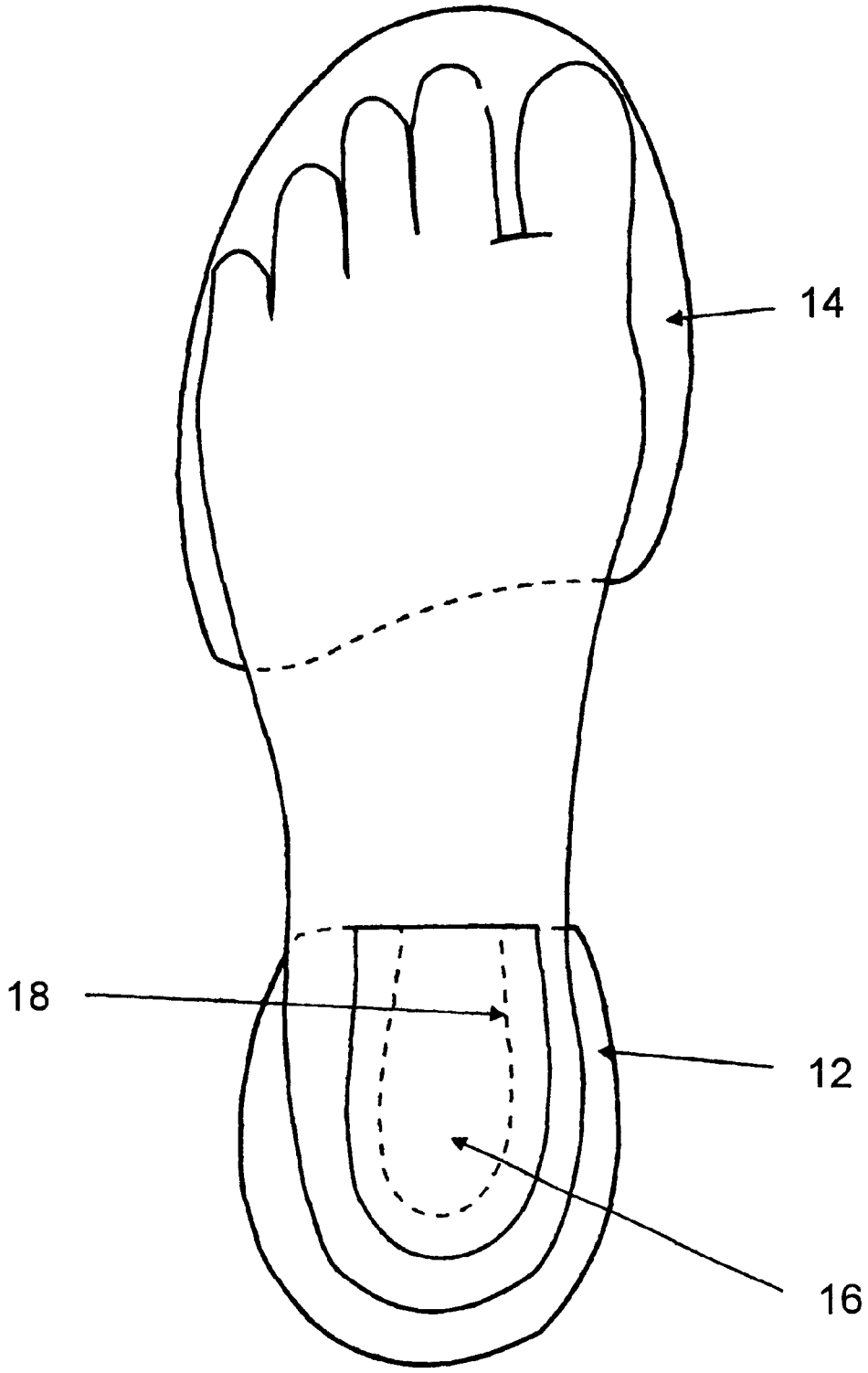
Figure 5:
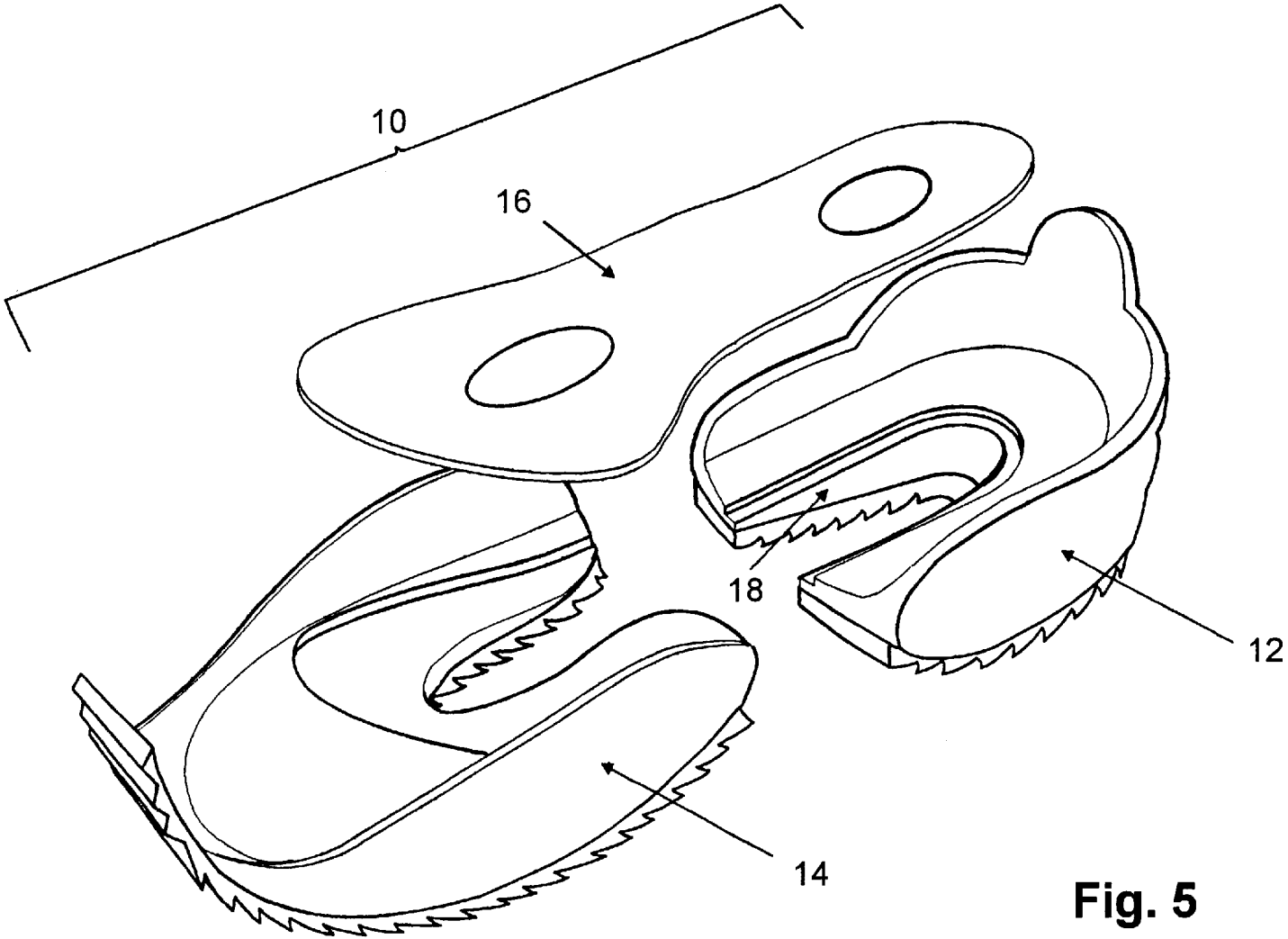

Two embodiments of the invention are explained in the following using the drawing. There are shown in:

FIG. 1 the sole of the dancing version of the shoe in an exploded representation;

FIG. 2 the sole of the dancing version in a view from below;

FIG. 3 the sole with the user's foot in vertical section;

FIG. 4 the user's foot with the shoe in a horizontal section;

FIG. 5 the sole of the sports version of the shoe in an exploded representation and FIG. 6 the sole of the sports version in a view from below.

FIGS. 1 to 4 show the dancing version of the shoe. FIG. 1 shows only sole 10. It contains a heel 12 and a ball section 14.

The heel 12 is U-shaped, the opening of the U-shape pointing forward. The opening is covered by a bridging element 16 on the upper side of the heel 12. The edge of the bridging element 16 overlaps the inner edge of the heel 12 to a width of approximately 1 centimeter. In this section, the inner edge 18 of the heel 12 is deepened according to the material thickness of the edge of the bridging element 16 so that the heel 12 and the bridging element 16 have an even surface when they are connected. The heel 12 and the bridging element 16 are flush at the front edge. The front edge of the heel 12 has an upwardly sloping face 20.

The ball section 14 is composed of the same material as the heel 12, but is separated from it. In the ball section 14, transverse strips 22 (FIG. 2) of suede are let in and sewn on. There are grooves 24 between these transverse strips 22 in order to give the shoe good roll-off properties.

The heel 12 and the ball section 14 are compression moulded from polyurethane.

The ball section 14 and the heel 12 are glued (FIG. 2) on the underside to the upper part of the shoe which is not shown in detail, and sewn on. Neoprene strips 26 are inserted on the underside between the heel 12 and the ball section 14 in order to give particular flexibility to this section.

As can be seen in particular in FIGS. 3 and 4, the bridging element lies essentially under the user's heel bone. Through the overlap section between bridging element 16 and heel 12, the user's weight is evenly concentrated on the section near the inner edge of the U shape, the result being an advantageous damping characteristic of the shoe. The pressure is thereby greater than with a heel without a free middle section. Because of the high density of the material of the heel, the latter can absorb this pressure elastically. The heel 12 is uniformly compression moulded from the high-density material polyurethane expediently, which means that it can absorb laterally-directed forces particularly well without being excessively deformed. The shoe thereby offers a special lateral stability. In combination with the large width of the heel 12, a particular resistance against tilting of the foot thereby results, as can be seen in FIG. 3.

Figure 6:
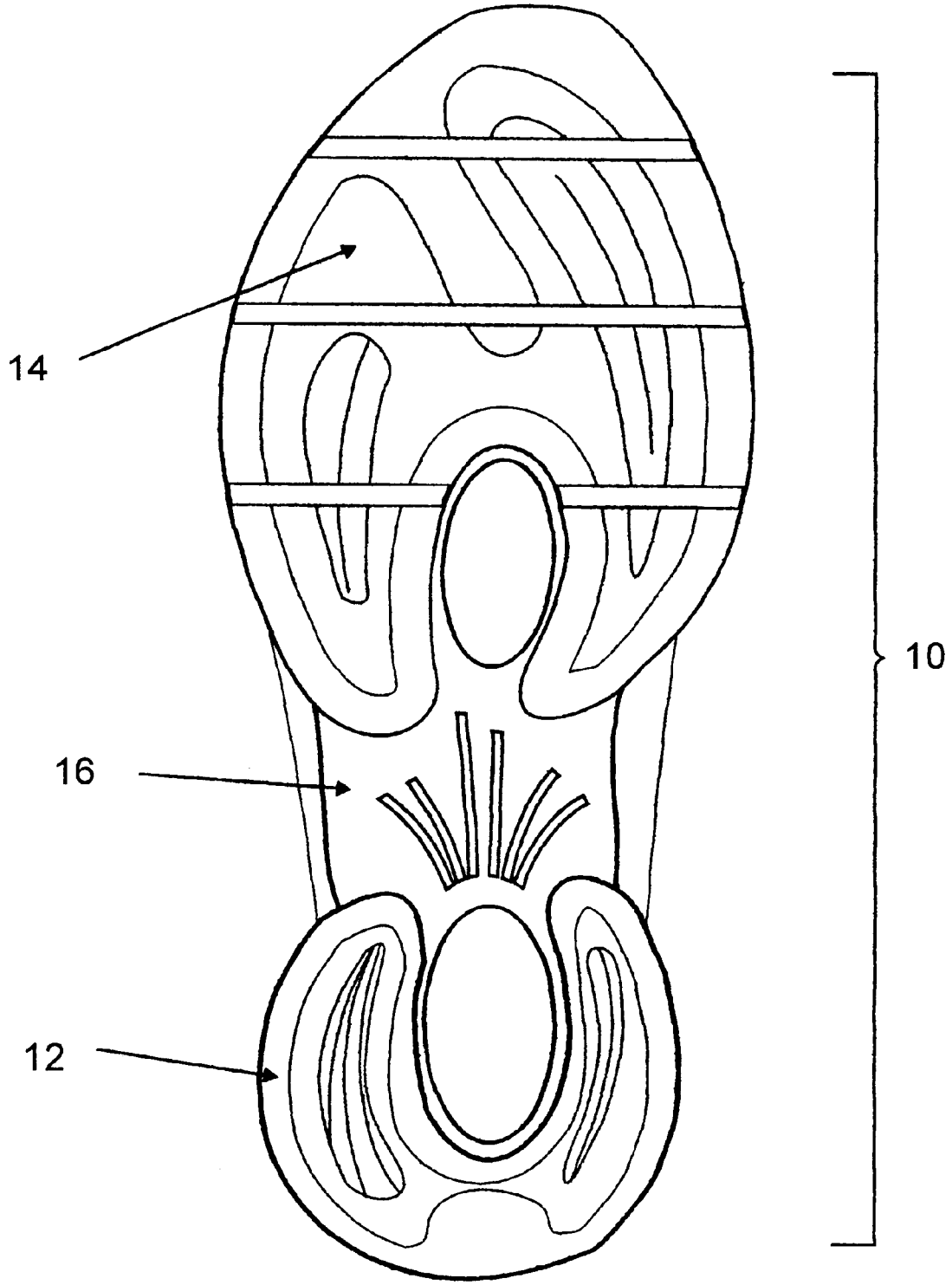

FIGS. 5 and 6 show the sports version of the shoe. The heel 12 is essentially constructed in exactly the same way as in the dancing version of FIGS. 1 and 2. The bridging element 16 is much longer than in the version in FIGS. 1 and 2. It is extended up to the ball section 14 so that it not only covers the opening or recess of the U shape of the heel 12, but is also glued to the rear third of the ball section 14. The bridging element 16 connects the heel 12 to the ball section 14.

The heel 12 and the ball section 14 are compression moulded from EVA and can have a coating of a conventional India-rubber or rubber mixture.

As shown in FIGS. 3 and 4, in this version also, the heel of the foot comes to rest over the opening of the U shape and bridging element 16, and the result, for the reasons given in connection with these Figures, is a better damping characteristic and lateral stability.

What is claimed is:

1. A shoe comprising a sole having a ball section and a heel, each having an upper portion and a lower portion, the heel defining an open middle section extending from the upper portion to the lower portion and said open middle section being bridged by a bridging element whereby downward forces presented to the bridging element are concentrated at an inner edge section formed in the upper portion of the heel wherein the bridging element has a middle sectional thickness greater than a peripheral sectional thickness.

2. The shoe according to claim 1, wherein said heel has a front edge and said open middle section of said heel reaches as far as said front edge of said heel so that said heel is U- or C-shaped.

3. The shoe according to claim 1, wherein said bridging element has an edge section overlapping with the inner edge of the heel.

4. The shoe according to claim 3, wherein the overlap is approximately 1 cm wide.

5. The shoe according to claim 1, wherein said ball section of said sole is separated from said heel and that both are connected to an upper part of the shoe without being directly connected to each other.

6. The shoe according to claim 5, wherein the heel is compression moulded from high-density polyurethane.

7. The shoe according to claim 1, wherein said bridging element extends from said heel and partially overlaps the ball section.

8. The shoe according to claim 7, wherein the heel is manufactured from EVA by compression moulding.

9. The shoe according to claim 2, wherein said bridging element has an edge section overlapping with the inner edge of the heel.

10. The shoe according to claim 9, wherein said bridging element extends from said heel and partially overlaps the ball section.

11. The shoe according to claim 3, wherein said bridging element extends from said heel and partially overlaps the ball section.

12. The shoe according to claim 5, wherein said bridging element extends from said heel and partially overlaps the ball section.

13. A shoe comprising:

a sole having a ball section and a heel, each having an upper portion and a lower portion, wherein the heel defines an open middle section extending from the upper portion to the lower portion and an inner edge section; and a bridging element disposed in the open middle section and supported by the inner edge section whereby downward forces presented to the bridging element are concentrated at the inner edge section and a portion of the bridging element overlaps a portion of the heel upper portion wherein the bridging element has a middle sectional thickness greater than a peripheral sectional thickness.

* * * * *